US007793930B2

(12) United States Patent
Lin

(10) Patent No.: US 7,793,930 B2
(45) Date of Patent: Sep. 14, 2010

(54) PAPER FEEDING MECHANISM

(75) Inventor: Cheng Lung Lin, Taipei (TW)

(73) Assignee: Teco Image Systems Co., Ltd., Taipei (TW)

( * ) Notice: Subject to any disclaimer, the term of this patent is extended or adjusted under 35 U.S.C. 154(b) by 1085 days.

(21) Appl. No.: 11/473,186

(22) Filed: Jun. 23, 2006

(65) Prior Publication Data

US 2006/0291944 A1 Dec. 28, 2006

(30) Foreign Application Priority Data

Jun. 24, 2005 (TW) ..... 94121288 A

(51) Int. Cl.
*B65H 1/00* (2006.01)

(52) U.S. Cl. ..... 271/171

(58) Field of Classification Search ..... 271/171
See application file for complete search history.

(56) References Cited

U.S. PATENT DOCUMENTS 4,568,074 A * 2/1986 Murayoshi ..... 271/171

FOREIGN PATENT DOCUMENTS

JP 03162322 A * 7/1991

JP 06032462 A * 2/1994

* cited by examiner

*Primary Examiner*—Gene Crawford
*Assistant Examiner*—Gerald W McClain
(74) *Attorney, Agent, or Firm*—Bacon & Thomas, PLLC

(57) ABSTRACT

A paper feeding mechanism applied to an office machine for feeding a paper is disclosed. The paper feeding mechanism comprises a first adjusting board having a first fixing component, a second adjusting board having a second fixing component, a paper feeding body having a first groove and a second groove wherein the first fixing component is penetrated through the first groove and the second fixing component is penetrated through the second groove, and a flexible component having a bending structure wherein one end of the flexible component is fixed on the first fixing component of the first adjusting board and the other end of the flexible component is fixed on the second fixing component of the second adjusting board. Thereby the first adjusting board and the second adjusting board are moved simultaneously and in opposite directions by means of the bending structure so as to adjust a relative distance between the first adjusting board and the second adjusting board in response to a size of the paper.

12 Claims, 3 Drawing Sheets

PAPER FEEDING MECHANISM

FIELD OF THE INVENTION

The present invention relates to a paper feeding mechanism, and more particularly to a paper feeding mechanism applied to an office machine.

BACKGROUND OF THE INVENTION

With the progress of the electronic technology, most office works rely on the functions of the copy machine, the fax machine, the printer, the scanner or the multi-function product, and such office machines become the indispensable equipments in the office. Generally, the office machine has a paper feeding mechanism, and the paper is placed on the paper feeding mechanism so as to be fed into the interior of the office machine for copying, faxing, printing or scanning.

Please refer to FIG. 1(*a*), which is an exploded view showing the conventional paper feeding mechanism. As shown in FIG. 1(*a*), the conventional paper feeding mechanism 10 comprises a paper feeding body 11, two adjusting boards 12, two racks 13 and a gear 14. Via the transmission of the racks 13 and the gear 14, the right and left adjusting boards 12 can be moved simultaneously and symmetrically so as to have a proper paper feeding width in response to the size of the paper and feed the paper smoothly.

The assembling process of the conventional paper feeding mechanism is described as follows. First, the protruding fastener 121 (as shown in FIG. 1(*b*)) at the back surface of the adjusting board 12 is penetrated through the corresponding groove 111 on the paper feeding body 11, and the rack 13 is engaged with the corresponding protruding fastener 121 of the adjusting board 12. Then, the two racks 13 are meshed with the gear 14, so that when one of the two adjusting boards 12 is moved toward one side by the user, the other adjusting board 12 will be moved toward the opposite direction automatically at the same time via the rotation of the gear 14 (as shown in FIG. 1(*b*)).

Through the cooperation of the racks 13 and the gear 14, the two adjusting boards 12 of the conventional paper feeding mechanism 10 can be simultaneously moved toward the opposite directions. However, when assembling the two adjusting boards 12 onto the grooves 11 of the paper feeding body 11, the insertion positions of the protruding fasteners 121 of the adjusting boards 12 may not precisely correspond to each other, and thus, the misalignment defect sometimes occurs after the racks 13 are engaged with the protruding fasteners 121 of the adjusting boards 12 and meshed with the gear 14. In other words, the width from the center (where the gear 14 is located) to the right adjusting board 12 is not equal to that from the center to the left adjusting board 12. As a result, the paper will be mispositioned and not confined to the range which is able to be scanned or printed when the paper is fed into the office machine. Hence, the copying, faxing, scanning or printing quality will be affected, and even more, parts of the contents on the paper may not be copied, faxed, scanned or printed.

Besides, since the pitch of the rack 13 is fixed, the conventional paper feeding mechanism cannot be finely adjusted. In addition, the applied force on the right side is not equal to that on the left side, so one of the two adjusting boards frequently gets stuck. Moreover, the conventional paper feeding mechanism has many assembling components and the assembling process thereof is complicated.

Therefore, it is required to provide a new paper feeding mechanism to overcome the defects of the above described prior art.

SUMMARY OF THE INVENTION

An object of the present invention is to provide a paper feeding mechanism, wherein the paper feeding mechanism comprises a flexible component which has a bending structure and the two ends thereof are respectively fixed to the first and second adjusting boards, so as to simultaneously move the first and second adjusting boards toward the opposite directions and avoid the aforesaid defects of the conventional paper feeding mechanism.

According to an aspect of the present invention, there is provided a paper feeding mechanism applied to an office machine for feeding a paper. The paper feeding mechanism comprises a first adjusting board having a first fixing component; a second adjusting board having a second fixing component; a paper feeding body having a first groove and a second groove, wherein the first fixing component is penetrated through the first groove and the second fixing component is penetrated through the second groove; and a flexible component having a bending structure, wherein one end of the flexible component is fixed on the first fixing component of the first adjusting board and the other end of the flexible component is fixed on the second fixing component of the second adjusting board. Thereby the first adjusting board and the second adjusting board are moved simultaneously and in opposite directions by means of the bending structure so as to adjust a relative distance between the first adjusting board and the second adjusting board in response to a size of the paper.

In an embodiment, the office machine is a copy machine, a fax machine, a printer, a scanner or a multi-function product.

In an embodiment, each of the first adjusting board and the second adjusting board has an upward-extending board at an outer lateral for placing the paper in a space formed therebetween.

In an embodiment, each of the first fixing component of the first adjusting board and the second fixing component of the second adjusting board has a fastener.

In an embodiment, each of the two ends of the flexible component has a hole for being engaged with the fastener of each of the first and second fixing components so as to fix the two ends of the flexible component on the first and second adjusting boards, respectively.

In an embodiment, the flexible component is a stainless steel piece or a plastic piece.

In an embodiment, the first groove and the second groove are strip-shaped grooves, so that the first fixing component of the first adjusting board is moved in the first groove and the second fixing component of the second adjusting board is moved in the second groove.

In an embodiment, the paper feeding body further comprises a plurality of rails abutting against the flexible component for supporting the flexible component.

In an embodiment, a bending angle of the bending structure of the flexible component is 180°.

According to another aspect of the present invention, there is provided an office machine comprising a main body having functions of copying, faxing, printing or scanning, and a paper feeding mechanism for feeding a paper to the office machine. The paper feeding mechanism comprises a first adjusting board having a first fixing component; a second adjusting board having a second fixing component; a paper feeding body having a first groove and a second groove, wherein the first fixing component is penetrated through the first groove and the second fixing component is penetrated through the second groove; and a flexible component having a bending structure, wherein one end of the flexible component is fixed on the first fixing component of the first adjusting board and the other end of the flexible component is fixed on the second fixing component of the second adjusting board. Thereby the first adjusting board and the second adjusting board are moved simultaneously and in opposite directions by means of the bending structure so as to adjust a relative distance between the first adjusting board and the second adjusting board in response to a size of the paper.

The above objects and advantages of the present invention will become more readily apparent to those ordinarily skilled in the art after reviewing the following detailed description and accompanying drawings, in which:

BRIEF DESCRIPTION OF THE DRAWINGS

FIG. 1(*b*) shows the assembled structure of the adjusting boards, the racks and the gear in FIG. 1(*a*);

FIG. 2(*b*) shows the assembled structure of the adjusting boards and the flexible component in FIG. 2(*a*);

FIG. 2(*c*) is a back side view showing the assembled paper feeding mechanism of FIG. 2(*a*); and FIG. 2(*d*) shows the movement of the flexible component in the assembled paper feeding mechanism of FIG. 2(*a*).

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1A:
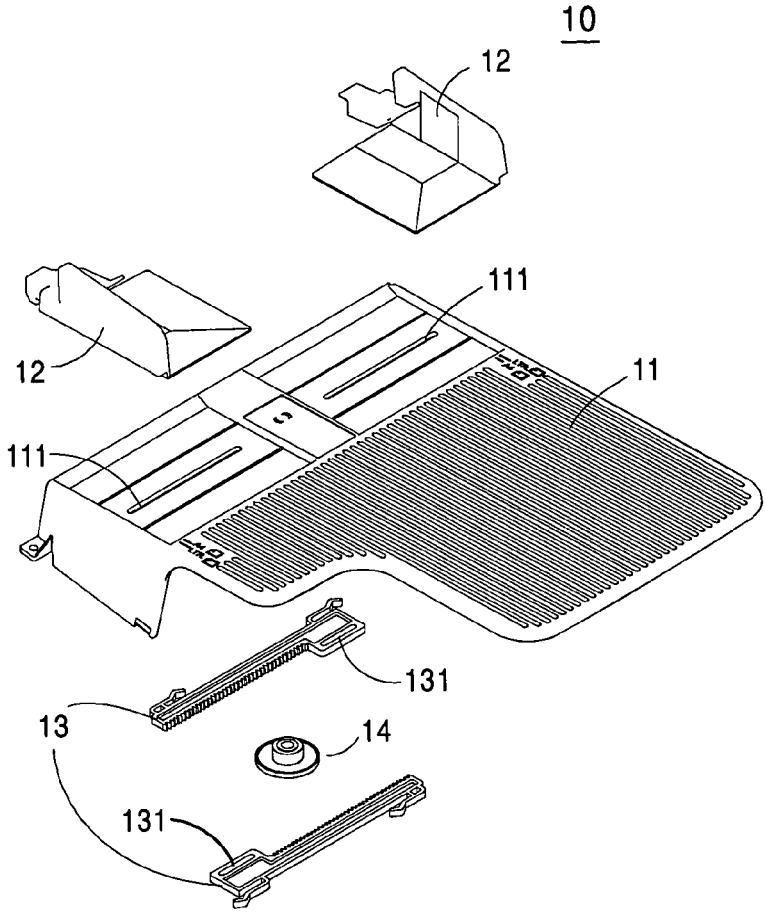
Fig. 1(a) Prior Art
FIG. 1(*a*) is an exploded view showing the conventional paper feeding mechanism.
Figure 1B:
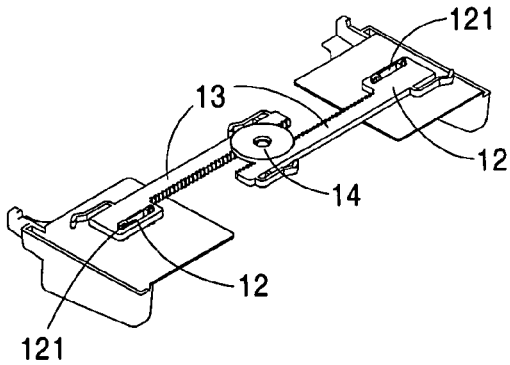
Fig. 1(b) Prior Art
Figure 2A:
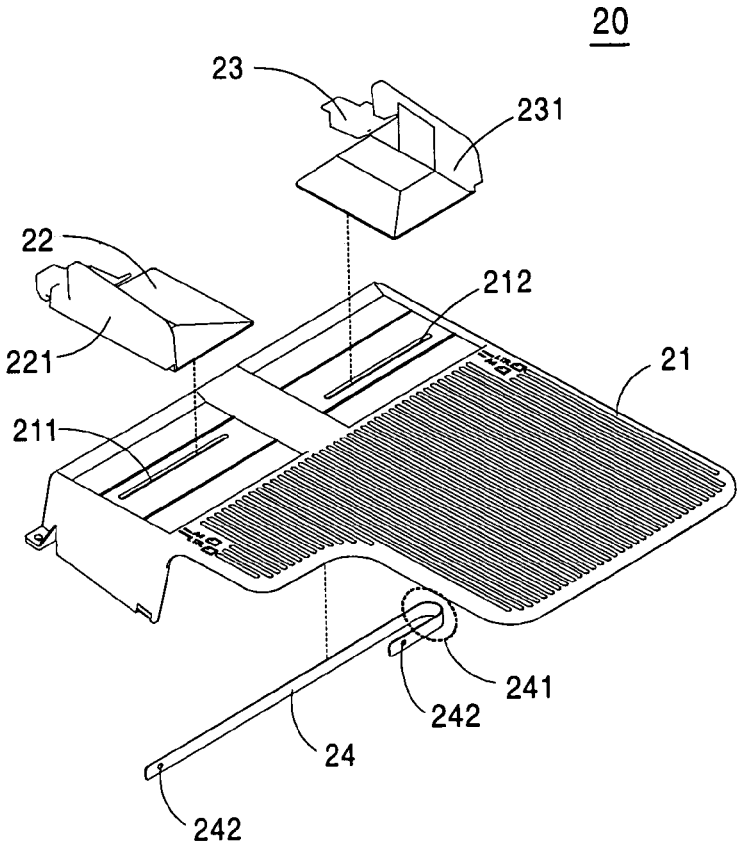
FIG. 2(*a*) is an exploded view showing the paper feeding mechanism according to the preferred embodiment of the present invention.
Figure 2B:
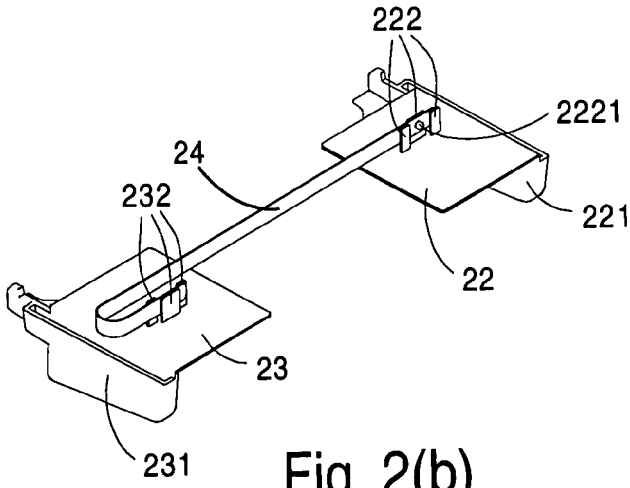
Figure 2C:
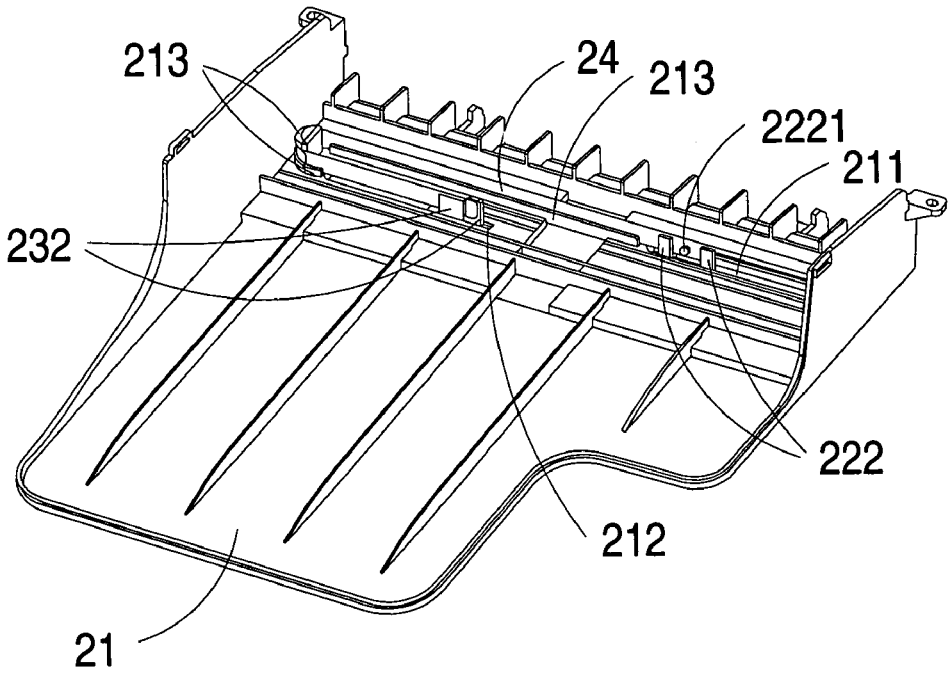
Figure 2D:
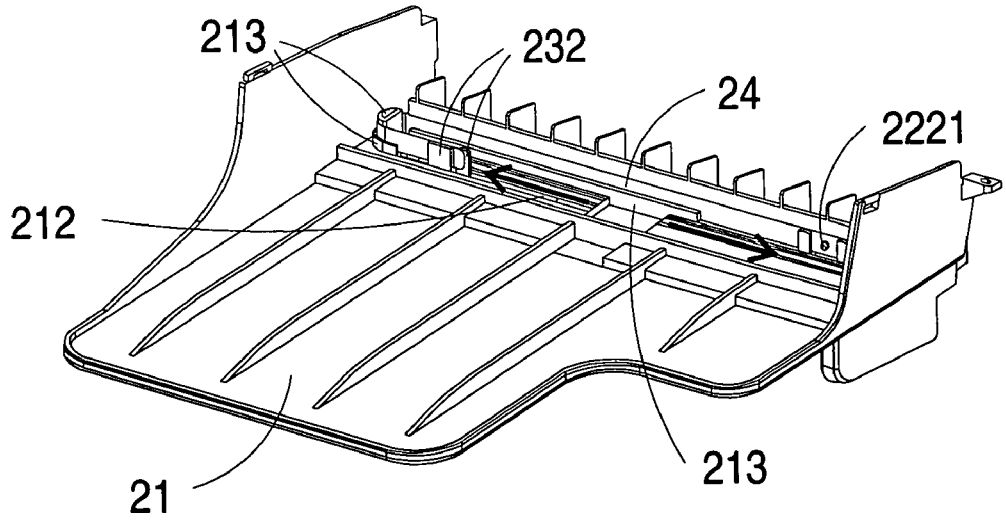

Please refer to FIG. 2(*a*), which is an exploded view showing the paper feeding mechanism according to the preferred embodiment of the present invention. The paper feeding mechanism 20 is applied to an office machine, such as a copy machine, a fax machine, a printer, a scanner or a multifunction product. The paper is placed on the paper feeding mechanism 20 so as to be fed into the main body of the office machine for copying, faxing, scanning or printing. As shown in FIG. 2(*a*), the paper feeding mechanism 20 comprises a paper feeding body 21, a first adjusting board 22, a second adjusting board 23 and a flexible component 24.

Since the paper to be processed by the office machine has various sizes, such as A4, A3, B4, B5 or LTR, there are two adjusting boards, i.e. the first adjusting board 22 and the second adjusting board 23, disposed on the paper feeding body 21. The first adjusting board 22 and the second adjusting board 23 have upward-extending boards 221 and 231, respectively, at the outer laterals thereof. The paper is placed in the space formed between the two upward-extending boards 221 and 231, and the relative distance between the two boards 221 and 231 can be adjusted in response to the size of the paper, so that the paper can be confined to the range which is able to be scanned or printed when the paper is fed into the office machine.

In addition, the first adjusting board 22 and the second adjusting board 23 have a first fixing component 222 and a second fixing component 232, respectively, at the back surfaces thereof. When assembling the paper feeding mechanism 20, the first fixing component 222 of the first adjusting board 22 is penetrated through the first groove 211 of the paper feeding body 21 to the backside of the paper feeding body 21 and the second fixing component 232 of the second adjusting board 23 is penetrated through the second groove 212 of the paper feeding body 21 to the backside of the paper feeding body 21 (as shown in FIGS. 2(*c*) and 2(*d*)). The first fixing component 222 of the first adjusting board 22 has a protruding fastener 2221 and the second fixing component 232 of the second adjusting board 23 also has a protruding fastener (not shown).

Please refer to FIG. 2(*a*) again. The flexible component 24 is formed of a flexible piece, such as a stainless steel piece or a plastic piece, and the flexible component 24 can be bent with an angle of 180° to form a bending structure 241 due to the flexibility thereof. Both the two ends of the flexible component 24 have a hole 242, respectively, and after the first and second fixing components 222 and 232 are respectively penetrated through the first and second grooves 211 and 212 as described above, the two ends of the flexible component 24 are inserted into the interiors of the first and second fixing components 222 and 232, respectively. Subsequently, the protruding fastener 2221 on the first fixing component 222 is penetrated through the hole 242 on one end of the flexible component 24 to be engaged with the flexible component 24 so that the first fixing component 222 of the first adjusting board 22 can be moved in right and left directions in the first groove 211 of the paper feeding body 21, and similarly, the protruding fastener on the second fixing component 232 is penetrated through the hole 242 on the other end of the flexible component 24 to be engaged with the flexible component 24 so that the second fixing component 232 of the second adjusting board 23 can be moved in right and left directions in the second groove 212 of the paper feeding body 21, as shown in FIGS. 2(*c*) and 2(*d*). Because of the bending structure 241 of the flexible component 24, when the user pushes one of the adjusting boards 22 or 23 to move toward the right or left direction, the other adjusting board 23 or 22 will be moved toward the opposite direction.

Since the two ends of the flexible component 24 are respectively fixed to the first and second adjusting boards 22 and 23, the first and second adjusting boards 22 and 23 can be moved simultaneously and in the opposite directions, and the misalignment defect of the conventional paper feeding mechanism can be avoided.

Therefore, by means of the flexibility of the flexible component 24 and the bending structure 241, the first and second adjusting boards 22 and 23 of the paper feeding mechanism 20 of the present invention can be moved simultaneously and in the opposite directions (shown as the arrows in FIG. 2(*d*)), and thus, the user can adjust the relative distance between the first and second adjusting boards 22 and 23 in response to the different sizes of the paper, so that the paper can be confined to the range which is able to be scanned or printed when the paper is fed into the office machine.

In the embodiment, the paper feeding body 21 further comprises a plurality of rails 213 disposed at the backside of the paper feeding body 21, and the rails 213 abut against the flexible component 24 for supporting the flexible component 24, so that the flexible component 24 can be stably and smoothly moved via the support of the rails 213, and the movement of the first and second adjusting boards 22 and 23 is smooth as well.

Further, the first and second grooves 211 and 212 of the paper feeding body 21 are strip-shaped grooves (as shown in FIG. 2(*a*)), so that the first fixing component 222 of the first adjusting board 22 can be moved right and left in the first groove 211, and the second fixing component 232 of the second adjusting board 23 can be moved right and left in the second groove 212.

In conclusion, according to the preferred embodiment of the present invention, the paper feeding mechanism comprises a flexible component which has the bending structure and the two ends thereof are respectively fixed to the first and second adjusting boards. In such design, the first and second adjusting boards can be moved simultaneously and in the opposite directions, and thus, the user can adjust the relative distance between the first and second adjusting boards in response to the different sizes of the paper, so that the paper can be confined to the range which is able to be scanned or printed when the paper is fed into the office machine. Moreover, the misalignment defect resulted from the mesh of the gear and the racks in the prior art can be avoided, and the distance between the two adjusting boards can be finely adjusted due to the transmission manner of the flexible component and the movement of the two adjusting boards is smoother. Further, the number of the assembling components is reduced and the assembling process is much simplified. Therefore, the paper feeding mechanism of the present invention possesses industrial value.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A paper feeding mechanism applied to an office machine for feeding a paper, said paper feeding mechanism comprising:

a first adjusting board having a first fixing component;

a second adjusting board having a second fixing component, wherein each of said first fixing component and said second fixing component has a fastener;

a paper feeding body having a first groove and a second groove, the first groove having a first axis passing through the first groove in a longitudinal dimension of the first groove, the second groove having a second axis passing through the second groove in a longitudinal dimension of the second groove, and said first fixing component is penetrated through said first groove and said second fixing component is penetrated through said second groove;

a flexible component having a bending structure, wherein one end of said flexible component is fixed on said first fixing component of said first adjusting board and the other end of said flexible component is fixed on said second fixing component of said second adjusting board, and each of said two ends of said flexible component has a hole for being engaged with said fastener of each of said first and second fixing components so as to fix said two ends of said flexible component on said first and second adjusting boards, respectively; and a plurality of rails disposed on said paper feeding body and abutting against said flexible component for supporting said flexible component;

thereby said first adjusting board and said second adjusting board are moved simultaneously and in opposite directions by means of said bending structure so as to adjust a relative distance between said first adjusting board and said second adjusting board in response to a size of said paper.

2. The paper feeding mechanism according to claim 1 wherein said office machine is a copy machine, a fax machine, a printer, a scanner or a multi-function product.

3. The paper feeding mechanism according to claim 1 wherein each of said first adjusting board and said second adjusting board has an upward-extending board at an outer lateral for placing said paper in a space formed therebetween.

4. The paper feeding mechanism according to claim 1 wherein said flexible component is a stainless steel piece or a plastic piece.

5. The paper feeding mechanism according to claim 1 wherein said first groove and said second groove are strip-shaped grooves, so that said first fixing component of said first adjusting board is moved in said first groove and said second fixing component of said second adjusting board is moved in said second groove.

6. The paper feeding mechanism according to claim 1 wherein a bending angle of said bending structure of said flexible component is 180°.

7. An office machine, comprising:

a main body having functions of copying, faxing, printing or scanning; and a paper feeding mechanism for feeding a paper to said office machine, said paper feeding mechanism comprising:

a first adjusting board having a first fixing component;

a second adjusting board having a second fixing component, wherein each of said first fixing component and said second fixing component has a fastener;

a paper feeding body having a first groove and a second groove, the first groove having a first axis passing through the first groove in a longitudinal dimension of the first groove, the second groove having a second axis passing through the second groove in a longitudinal dimension of the second groove, wherein said first axis and said second axis are parallel to and offset from one another, and said first fixing component is penetrated through said first groove and said second fixing component is penetrated through said second groove;

a flexible component having a bending structure, wherein one end of said flexible component is fixed on said first fixing component of said first adjusting board and the other end of said flexible component is fixed on said second fixing component of said second adjusting board, and each of said two ends of said flexible component has a hole for being engaged with said fastener of each of said first and second fixing components so as to fix said two ends of said flexible component on said first and second adjusting boards, respectively; and a plurality of rails disposed on said paper feeding body and abutting against said flexible component for supporting said flexible component;

thereby said first adjusting board and said second adjusting board are moved simultaneously and in opposite directions by means of said bending structure so as to adjust a relative distance between said first adjusting board and said second adjusting board in response to a size of said paper.

8. The paper feeding mechanism according to claim 7 wherein said office machine is a copy machine, a fax machine, a printer, a scanner or a multi-function product.

9. The paper feeding mechanism according to claim 7 wherein each of said first adjusting board and said second adjusting board has an upward-extending board at an outer lateral for placing said paper in a space formed therebetween.

10. The paper feeding mechanism according to claim 7 wherein said flexible component is a stainless steel piece or a plastic piece.

11. The paper feeding mechanism according to claim 7 wherein said first groove and said second groove are strip-shaped grooves, so that said first fixing component of said first adjusting board is moved in said first groove and said second fixing component of said second adjusting board is moved in said second groove.

12. The paper feeding mechanism according to claim 7 wherein a bending angle of said bending structure of said flexible component is 180°.

* * * * *